US006532781B1

(12) United States Patent
Keller

(10) Patent No.: US 6,532,781 B1
(45) Date of Patent: Mar. 18, 2003

(54) BUILT-IN SAFETY DEVICE AND KEY FOR A SAFETY LOCK

(76) Inventor: Ernst Keller, Untere Schwandenstrasse 22, CH-8805 Richterswil (CH)

( * ) Notice: Subject to any disclaimer, the term of this patent is extended or adjusted under 35 U.S.C. 154(b) by 0 days.

(21) Appl. No.: 09/673,399

(22) PCT Filed: Apr. 9, 1999

(86) PCT No.: PCT/CH99/00145

§ 371 (c)(1),
(2), (4) Date: Oct. 17, 2000

(87) PCT Pub. No.: WO99/54574

PCT Pub. Date: Oct. 28, 1999

(30) Foreign Application Priority Data

Apr. 17, 1998 (CH) ..... 886/98

(51) Int. Cl.[7] ..... E05B 9/04; E05B 19/06; E05B 27/06

(52) U.S. Cl. ..... 70/358; 70/373; 70/375; 70/409; 70/454; 70/493; 70/DIG. 60

(58) Field of Search ..... 70/DIG. 60, 409, 70/358, 493, 375, 453, 454, 372, 373, 385, DIG. 5

(56) References Cited

U.S. PATENT DOCUMENTS

| | | | | | |
|---|---|---|---|---|---|
| 3,824,818 | A | * | 7/1974 | Neale | 70/DIG. 60 X |
| 4,098,103 | A | * | 7/1978 | Raskevicius | 70/419 X |
| 4,195,504 | A | * | 4/1980 | Foshee | 70/DIG. 60 X |
| 4,391,112 | A | * | 7/1983 | Neyret | 70/373 X |
| 5,666,835 | A | * | 9/1997 | Keller | 70/DIG. 60 X |

FOREIGN PATENT DOCUMENTS

| | | | | | |
|---|---|---|---|---|---|
| DE | 2541159 | | * | 4/1976 | 70/DIG. 60 |
| DE | 2614890 | | * | 10/1977 | 70/DIG. 60 |
| DE | 2905565 | | * | 9/1979 | 70/DIG. 60 |
| DE | 31 27 449 | | | 2/1983 | |
| DE | 32 26 607 | | | 1/1984 | |
| DE | 35 15 384 | | | 10/1986 | |
| DE | 40 41 207 | | | 4/1992 | |
| DE | 4213382 | A1 | * | 7/1993 | 70/DIG. 60 |
| EP | 0 396 492 | | | 11/1990 | |
| FR | 980458 | | | 5/1951 | |
| FR | 982372 | | | 6/1951 | |
| FR | 2 114 962 | | | 6/1972 | |
| GB | 500540 | | | 2/1939 | |
| GB | 1581095 | | * | 12/1980 | 70/DIG. 60 |
| HU | 218323 | B | | 7/2000 | |
| HU | 218324 | B | | 7/2000 | |
| NL | 25809 | | * | 7/1932 | 70/DIG. 60 |

* cited by examiner

*Primary Examiner*—Lloyd A. Gall
(74) *Attorney, Agent, or Firm*—Browdy and Neimark, P.L.L.C.

(57) ABSTRACT

The invention relates to a built-in safety device comprising a housing (3) and a rotor (4) mounted therein. Tumblers (8) are mounted in the housing (3) and in the rotor (4). The maximal length (A) of the built-in safety device (1) is approximately 40 mm, and the effective part **(2*c*) of the key (2) is essentially as long as the rotor (4). In addition, the rotor (4)** is constructed as one piece and can be operated from both sides thereof. The inventive built in safety device can be installed in a mortise lock more easily than a cross-key bit safety device and permits the production of a locking system.

11 Claims, 6 Drawing Sheets

BUILT-IN SAFETY DEVICE AND KEY FOR A SAFETY LOCK

CROSS REFERENCE TO RELATED APPLICATION

The present application is the national stage under 35 U.S.C. 371 of PCT/CH99/00145, filed Apr. 9, 1999.

BACKGROUND OF THE INVENTION

1. Technical Field of the Invention

The invention relates to a cylinder lock assembly and a key.

2. Prior Art

Cylinder lock assemblies in the form of cross bit assemblies have been known for a long time. Such cross bit assemblies are installed in the lock case and secured by screws. Installation is comparatively time consuming while locking safety is comparatively modest.

OBJECT AND SUMMARY OF THE INVENTION

It is thus the object of the invention to create a cylinder lock assembly which essentially can be inserted in any usual commercial lock, without requiring any rework.

Essentially, the cylinder lock assembly according to the invention is similar to a rotary locking cylinder, except that it is significantly shorter than a rotary locking cylinder and that it comprises a through-rotor which can be operated from either side using a key. The length of the effective part of the key is essentially the same as that of the rotor.

The cylinder lock assembly according to the invention provides for two escutcheon plates or rosettes, each comprising a rotatable sleeve as a key guide. This key guide guides the key positively into the key channel of the cylinder lock assembly. The key guide is rotatably held in the escutcheon plate or the rosette; during the locking action it rotates together with the key. One significant advantage of the cylinder lock assembly consists of the assembly being invisible from the outside and, due to its short length, not protruding, making it resistant to breaking off. Thus the length of the cylinder lock assembly is less than the thickness of the door leaf.

The cylinder lock assembly according to the invention can have any usual commercial profile, for example the European profile, the Swiss profile or an English or Scandinavian oval profile. The cylinder lock assembly according to the invention provides an advantage in that the driver can be arranged either symmetrically or asymmetrically. This is possible in particular due to the through-rotor. Such asymmetric arrangement is advantageous in the case of rebated doors. Furthermore, the cylinder lock assembly according to the invention makes it possible to establish a small locking system, for example comprising several apartment keys and one central key. It is also possible to provide keys which only permit operation of the cylinder lock assembly from the left or from the right. Preferably the followers are arranged such that locking from the outside differs from locking from the inside. In this case as has been mentioned it is possible to have a key which only locks from the outside and it is possible to have a further key which only locks from the inside. Of course such a small locking system also provides the option of a main key which locks both from the inside and from the outside.

Preferably, slides for the followers are held in the housing. These slides are perforated differently and preferably directly supported at the driver. This provides the significant advantage of any knocking out of the rotor being largely impossible. If the slides are perforated differently, by inserting such slides, hole patterns can be created which result in new locking arrangements.

It is important that the cylinder lock assembly is always significantly shorter than the width of the door in which it will be installed. Preferably, the cylinder lock assembly is approx. 5 to 10 mm shorter. In this case the cylinder lock assembly does not protrude at the exterior of the door and correspondingly cannot be gripped and broken off. This significantly increases the safety provided by any door. The same is also possible in the case of rebated doors since in this case the driver can be arranged asymmetrically.

BRIEF DESCRIPTION OF THE DRAWINGS

Further advantageous features are presented in the claims, the description below and the drawing.

Below, one embodiment of the invention is shown in more detail by means of the drawing, as follows.

DETAILED DESCRIPTION OF THE PREFERRED EMBODIMENT(S) OF THE INVENTION

Figure 1:
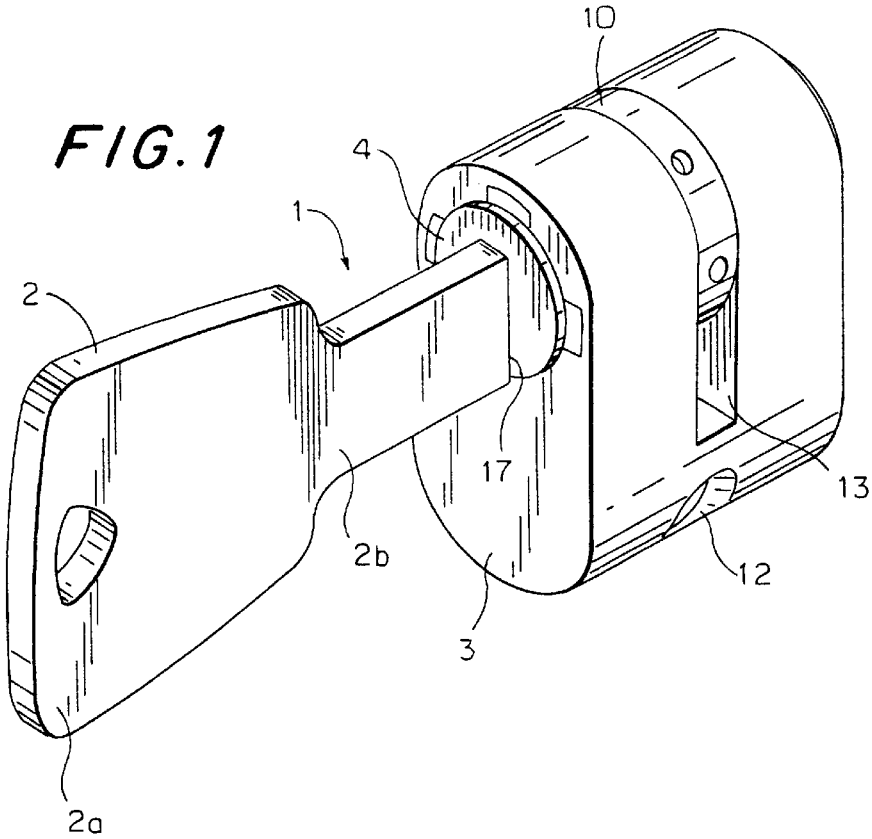
FIG. 1 shows a cylinder lock assembly according to the invention, with a key inserted.
Figure 2:
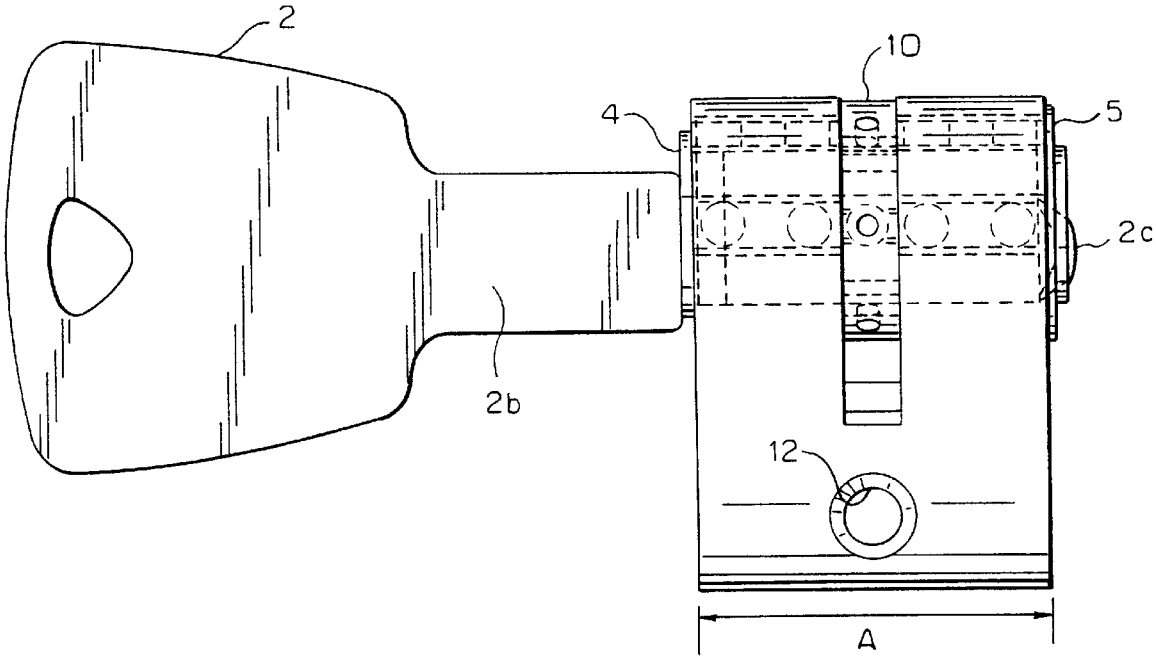
FIG. 2 provides a further view of the cylinder lock assembly with key.

The cylinder lock assembly shown in FIGS. 1 and 2 comprises a housing 3 in which a single-piece rotor 4 is rotatably held. The rotor 4 comprises a continuous key channel 17 into which the effective part 2*c* of a safety key 2 is inserted. Between the effective part 2*c* and the grip part 2*a* there is a guide stay 2*b*. The function of this guide stay 2*b* is explained in more detail later. The rotor 4 is secured by a clamping ring 5. The lower part of the housing 3 comprises a double vent screw borehole 12. A driver 10 is attached to the rotor 4, said driver 10 being held in slot 13 of the housing 3.

Figure 3:
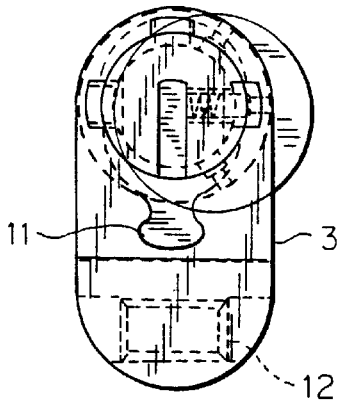
FIG. 3 provides a further view of the cylinder lock assembly.
Figure 4:
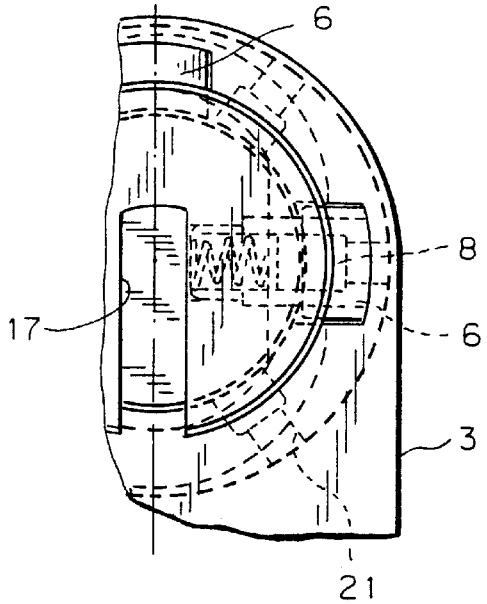
FIG. 4 is an enlarged partial view according to FIG. 3.

As shown in FIGS. 3 and 4, three slides 6 are inserted in the housing 3, said slides accommodating the housing pins 8 of the followers (not shown) which are known per se. These followers are spring loaded in the known way; they interact with control surfaces in the effective part 2*c* of the key 2.

Figure 5:
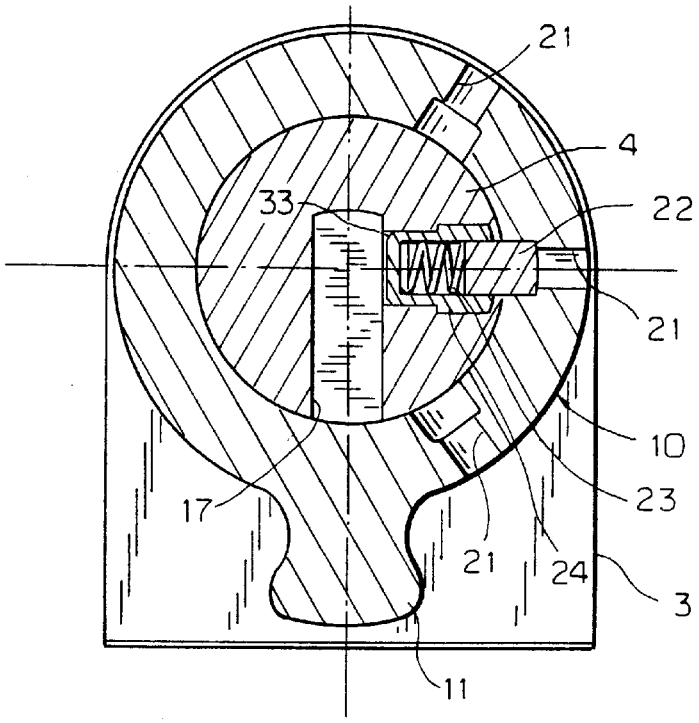
FIG. 5 is a sectional view of a cylinder lock assembly according to the invention.

According to FIG. 5, to rotationally secure the driver 10, the rotor 4 comprises a borehole 33 with an inserted sleeve 24 which accommodates a compression spring 23 as well as a securing pin 22. This securing pin 22 interacts with a stepped borehole 21 of the driver 10. Three such boreholes 21, spaced apart, are provided; they can selectively be used for various rotational positions of the driver 10. In this case, the middle borehole 21 is used.

Figure 6:
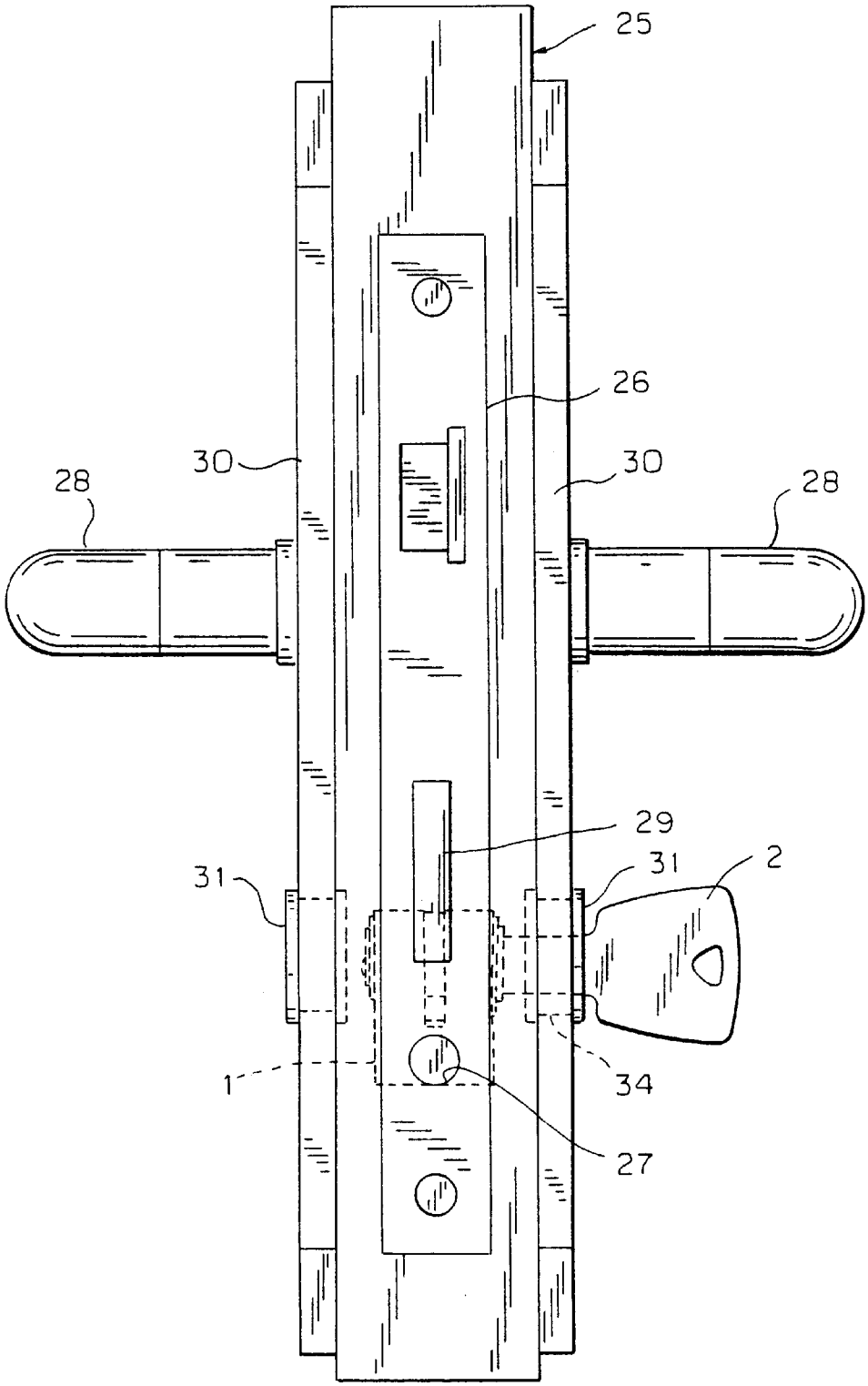
FIG. 6 is a partial view of a door with a cylinder lock assembly installed and with a pair of handles.

FIG. 6 shows a door 25 which comprises a usual mortise lock 26. This mortise lock 26 shows the usual bolt 29 as well as a borehole 27 for a double vent screw. The door 25 comprises the usual pair of handles comprising two individual handles 28 as well as two escutcheon plates 30. As shown, the cylinder lock assembly 1 is inserted in the lock case 26 where it is attached by means of the double vent screw (not shown). It is essential that the length A, shown in FIG. 2, of the cylinder lock assembly 1, is such that the cylinder lock assembly 1 protrudes only slightly on both sides of the lock case 26, as shown in FIG. 6. Thus the length of the cylinder lock assembly 1 is significantly less than the width of the door 25. Thus the cylinder lock assembly 1 is neither visible nor directly accessible. It can therefore not be gripped by means of a tool and broken off.

Figure 7:
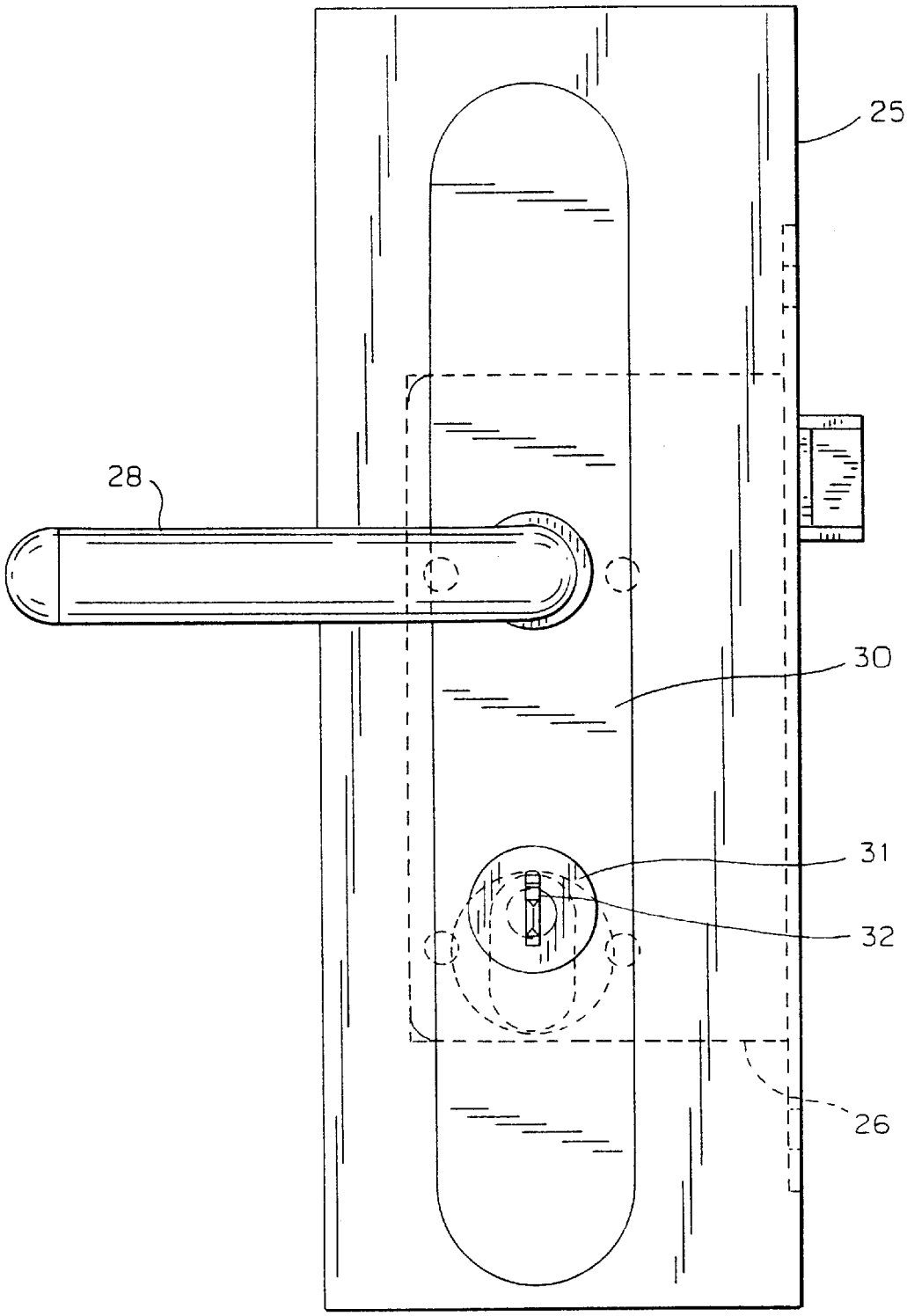
FIG. 7 is a further partial view of the door according to FIG. 6.

The key 2 penetrates a guide bush 31 which during insertion guides the key 2 by the guide stay 2*b*. The guide bush 31 is rotatably held in a borehole 34 of a door plate 30. The door plate 30 may also be a rosette or similar. To accommodate the key 2, the guide bush 31 according to FIG. 7 comprises a guide slot 32 extending across the entire depth of the guide bush 31. The guide bush 31 ensures that when the key 2 is inserted, it is guided into the key channel 17 of the rotor 4.

Figure 8:
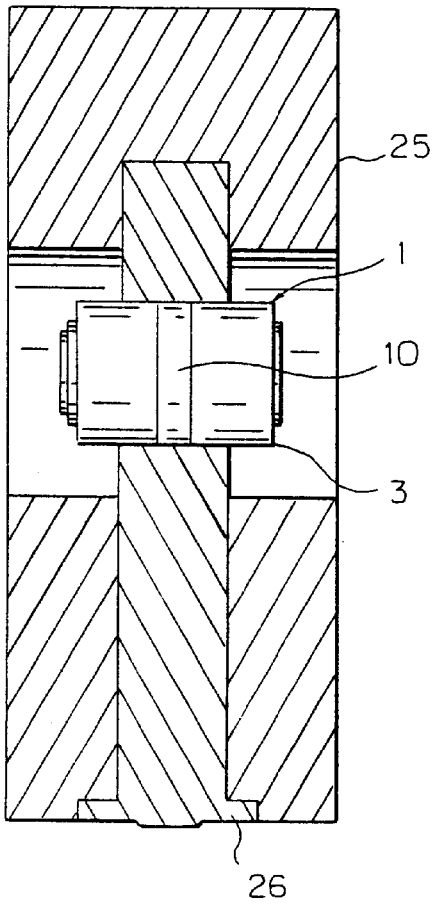
FIG. 8 provides a diagrammatic view of a cylinder lock assembly installed in a lock case, with symmetrical arrangement of the driver.
Figure 9:
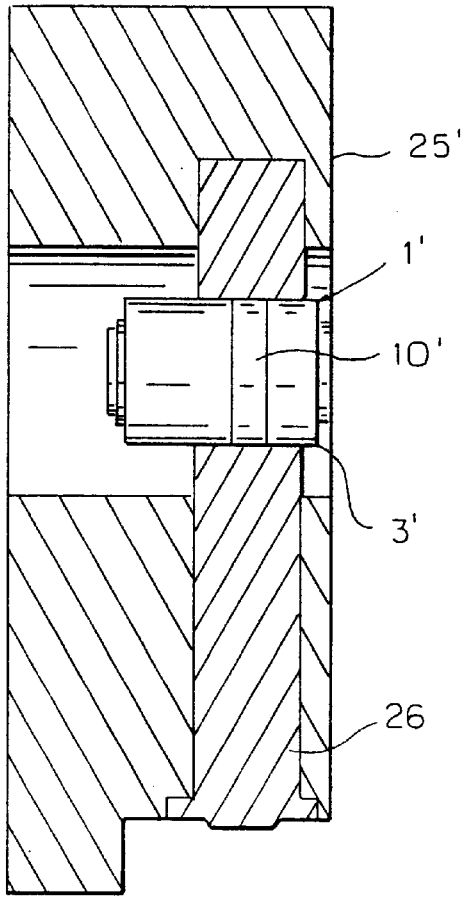
FIG. 9 corresponds to FIG. 8, except that the arrangement of the driver is asymmetrical with the door being rebated.

FIG. 8 diagrammatically shows the arrangement of the cylinder lock assembly 1 in a door 25, in this case a blunt, i.e. non-rebated door. As is shown, the driver 10 is arranged symmetrically in relation to the mortise lock 26. FIG. 9 shows a rebated door 25' whose mortise lock 26 is arranged asymmetrically. Correspondingly, the cylinder lock assembly 1' comprises a housing 3' in which the driver 10' is arranged asymmetrically. The asymmetric arrangement of the driver 10' makes it possible to install the cylinder lock assembly 1' so that on the outside it does not protrude from the door 25'. After installation of the escutcheon plates 30 or the rosettes (not shown), the cylinder lock assembly 3' is not visible from the outside and is not directly accessible.

FIGS. 10*a* to 10*d* show four keys 2, 2', 2" and 2'" of a small locking system. The grip parts 2*a* of the keys are not shown. According to FIG. 10*a* each of the keys comprises an effective part 2*c* comprising two narrow sides 18 and two broad sides 19. The broad sides 19 comprise boreholes 14, 15 and 16. These boreholes form control surfaces, with the depth of said boreholes varying; as usual, in this drawing the depth is indicated by numbers.

Figure 10A:
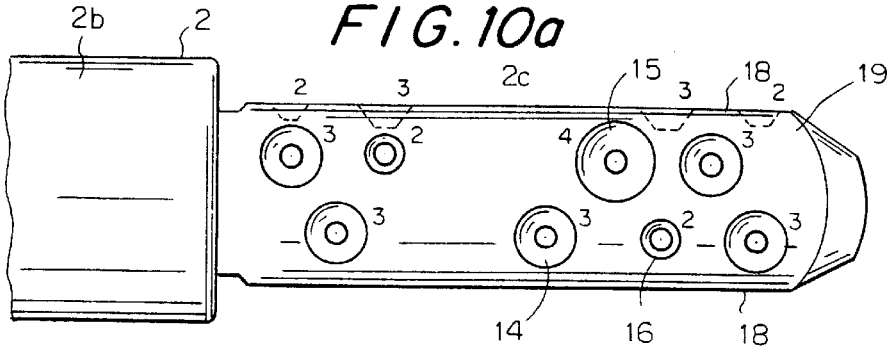
FIGS. 10*a* to 10*d* show keys according to the invention, of a locking system of the cylinder lock assembly according to the invention.
Figure 10B:
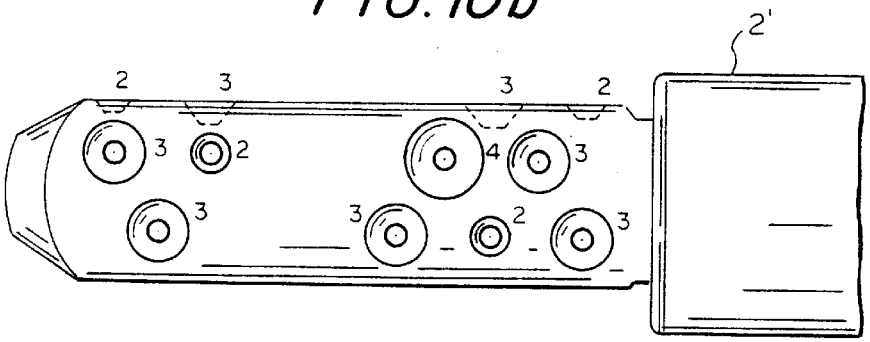
Figure 10C:
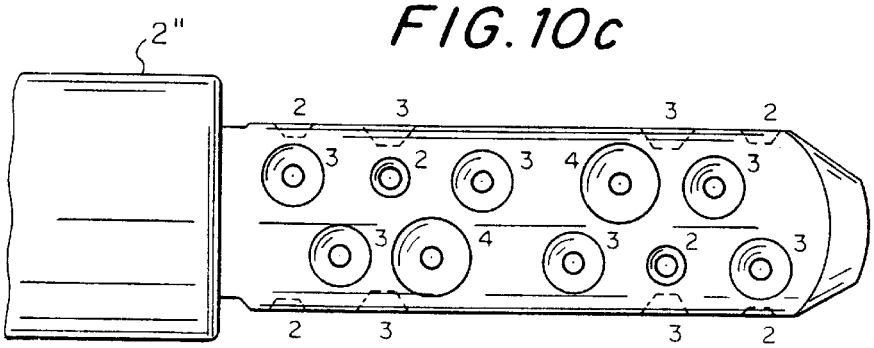
Figure 10D:
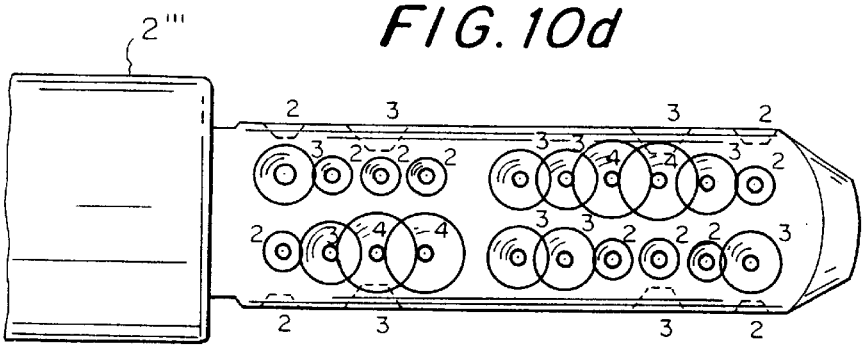

The key 2 shown in FIG. 10*a* is an apartment key which allows operation of an associated cylinder lock assembly only from one side, for example from the left. The key 2' shown in FIG. 10*b* is also an apartment key; it can operate the associated cylinder lock assembly 1 from the other side, i.e. for example from the right. The key 2" shown in FIG. 10*c* is also an apartment key; it allows operation of the associated cylinder lock assembly 1 from both sides. Finally, FIG. 10*d* shows a key 2'" which is a central key; it allows operation for example of a main entrance door as well as various apartment doors. FIGS. 10*a* to 10*d* show the symmetrical arrangement of the boreholes and borehole groups.

The cylinder lock assembly 1 can thus be configured such that its two sides comprise different locking arrangements which differ in that they can be operated by different keys 2 or 2'. The two sides of the cylinder lock assembly 1 can however be designed such that their locking arrangements are the same so that they can be operated by the same key 2 or 2'. The key 2 can comprise two or four sets of boreholes with corresponding control surfaces. According to FIGS. 10*c* and 10*d*, these borehole sets are arranged symmetrically.

What is claimed is:

1. A cylinder lock assembly and key for a safety lock with a lock case (26), comprising a housing (3) and a rotor (4) held in said housing (3), and comprising housing pins (8) arranged in the housing (3) in slides (6) and in the rotor (4) and a key channel (17) arranged in the rotor (4), with an effective part (2*c*) of the key (2) comprising control surfaces (14–16) having to be inserted into said key channel (17) so as to arrange the housing pins (8), with the length (A) of the cylinder lock assembly (1) at most being approximately 40 mm and with the effective part (2*c*) of the key (2) essentially being as long as the rotor (4), and with the rotor (4) being made in one piece which can be operated from either side, with the key (2) being a reversible key comprising two narrow sides (18) with control surfaces as well as two broad sides (19) with control surfaces (14–16) and a guide part (2*b*) arranged between a grip part (2*a*) of the key and the effective part (2*c*), with the key (2) in a door (25) being guided by said guide part (2*b*).

2. A cylinder lock assembly and key according to claim 1, wherein the two narrow and two broad sides comprise different locking arrangements.

3. A cylinder lock assembly and key according to claim 1, wherein one end of the rotor (4) is secured by a clamping ring (5).

4. A cylinder lock assembly and key according to claim 1, wherein the effective part (2*c*) of the key (2', 2") comprises two sets or four sets of bore-holes comprising the control surfaces (14–16).

5. A cylinder lock assembly and key according to claim 1, wherein a top of the housing (3) has a slot (13) for holding a driver (10) and that said slot (13) is arranged symmetrically or asymmetrically.

6. A cylinder lock assembly and key according to claim 5, wherein the driver (10) comprises several boreholes (21), spaced apart, for accommodating a securing pin (22).

7. A cylinder lock assembly and key according claim 5, wherein the housing (3) is made in one piece.

8. A cylinder lock assembly and key according to claim 1, wherein the key comprises a guide stay (2*b*) between the grip part (2*a*) and the effective part (2*c*).

9. A cylinder lock assembly and key according to claim 8, wherein the key has two or four sets of boreholes comprising the control surfaces (14–16).

10. A cylinder lock assembly and key according to claim 1, further comprising a pair of handles having cover parts (30) with a rotatable guide bush (31) being held in each of said cover parts (30).

11. A cylinder lock assembly and key according to claim 10, wherein the guide bush (31) has a guide slot (32) which is made so as to correspond with a guide part (2*b*) of the key (2).

* * * * *